US012110600B2

(12) United States Patent
Hashemi

(10) Patent No.: US 12,110,600 B2
(45) Date of Patent: Oct. 8, 2024

(54) CATHODIC PROTECTION OF METAL SUBSTRATES

(71) Applicant: COPSYS TECHNOLOGIES INC., Logy Bay (CA)

(72) Inventor: Farzad Hashemi, Halifax (CA)

(73) Assignee: COPSYS TECHNOLOGIES INC., Logy Bay (CA)

( * ) Notice: Subject to any disclaimer, the term of this patent is extended or adjusted under 35 U.S.C. 154(b) by 0 days.

(21) Appl. No.: 18/384,088

(22) Filed: Oct. 26, 2023

(65) Prior Publication Data

US 2024/0052500 A1 Feb. 15, 2024

Related U.S. Application Data

(62) Division of application No. 16/609,590, filed as application No. PCT/IB2018/052993 on Apr. 30, 2018, now Pat. No. 11,840,767.

(Continued)

(51) Int. Cl.
*C23F 13/16* (2006.01)
*C23F 13/20* (2006.01)

(52) U.S. Cl.
CPC ..... *C23F 13/16* (2013.01); *C23F 13/20* (2013.01); *C23F 2213/31* (2013.01); *C23F 2213/32* (2013.01)

(58) Field of Classification Search
CPC ..... C23F 13/16; C23F 13/20; C23F 13/08; C23F 2201/02; C23F 2213/31; C23F 2213/32
See application file for complete search history.

(56) References Cited

U.S. PATENT DOCUMENTS 3,001,919 A 9/1961 Petrocokino
3,471,395 A 10/1969 Sumner
(Continued)

FOREIGN PATENT DOCUMENTS

CA 1094976 2/1981
CA 2558790 A1 11/2005
(Continued)

OTHER PUBLICATIONS

International Preliminary Report on Patentability, dated Dec. 19, 2017, by WIPO, re PCT International Patent Application No. PCT/IB2016/053503.

(Continued)

*Primary Examiner* — Alexander W Keeling
*Assistant Examiner* — Mofoluwaso S Jebutu
(74) *Attorney, Agent, or Firm* — Perry + Currier Inc.

(57) ABSTRACT

A metallic object to be protected from corrosion, such as a steel automobile body panel, is connected to an electron source as a cathode. An electrically isolating coating is disposed on the metallic object. A blanket anode is applied onto the electrically isolating coating. The blanket anode is electrically conductive. A non-metallic electrode is connected to the blanket anode and to the electron source. Hydrogen absorbent mixtures are added to the coating. Capillary action is addressed. Damage to the blanket anode and the electrically isolating coating creates a location for electrolyte to collect to create an electrochemical cell and activate cathodic protection to prevent corrosion of the metallic object.

11 Claims, 9 Drawing Sheets

Related U.S. Application Data

(60) Provisional application No. 62/492,570, filed on May 1, 2017.

(56) References Cited

U.S. PATENT DOCUMENTS

| | | | | |
|---|---|---|---|---|
| 3,868,313 | A * | 2/1975 | Gay | C23F 13/02 204/196.36 |
| 4,219,807 | A | 8/1980 | Speck et al. | |
| 4,224,384 | A | 9/1980 | Kozawa et al. | |
| 4,226,694 | A | 10/1980 | Baboian et al. | |
| 4,235,681 | A | 11/1980 | Shreir | |
| 4,473,450 | A | 9/1984 | Nayak et al. | |
| 4,528,460 | A | 7/1985 | Staerzl | |
| 4,664,764 | A | 5/1987 | Zofan | |
| 4,767,512 | A | 8/1988 | Cowatch et al. | |
| 4,780,189 | A | 10/1988 | Ridgley | |
| 4,806,272 | A | 2/1989 | Wiley | |
| 4,812,212 | A | 3/1989 | Dimond et al. | |
| 4,828,665 | A | 5/1989 | McCready | |
| 4,950,372 | A | 8/1990 | McCready | |
| 5,102,514 | A | 4/1992 | McCready | |
| 5,407,549 | A | 4/1995 | Camp | |
| 5,476,576 | A | 12/1995 | Solomon et al. | |
| 5,478,451 | A | 12/1995 | Riffe | |
| 6,046,515 | A | 4/2000 | Lewis | |
| 6,261,439 | B1 | 7/2001 | Schwabe et al. | |
| 6,572,760 | B2 | 6/2003 | Whitmore | |
| 6,875,336 | B2 | 4/2005 | Lewis et al. | |
| 7,025,013 | B1 * | 4/2006 | Staerzl | B63B 59/04 114/222 |
| 7,410,563 | B2 | 8/2008 | Komatsu et al. | |
| 7,901,547 | B2 | 3/2011 | Richardson | |
| 8,557,089 | B2 | 10/2013 | Schutt | |
| 2002/0088720 | A1 | 7/2002 | Lewis et al. | |
| 2006/0054072 | A1 | 3/2006 | Sica et al. | |
| 2014/0224670 | A1 * | 8/2014 | Ishikawa | C23F 13/16 204/196.01 |
| 2017/0130341 | A1 | 5/2017 | Suzuki et al. | |

FOREIGN PATENT DOCUMENTS

| | | | |
|---|---|---|---|
| EP | 3128040 | A1 | 2/2017 |
| GB | 2485887 | A | 5/2012 |
| WO | WO-2016203368 | A1 | 12/2016 |

OTHER PUBLICATIONS

International Search Report dated Sep. 19, 2016 for PCT Patent Application No. PCT/IB2016/053503.

ISA/CA, International Search Report and Written Opinion, Aug. 8, 2018, re PCT International Patent Application No. PCT/IB2018/052993.

ISA/CA, International Preliminary Report on Patentability (Ch. 1), Nov. 5, 2019, re PCT International Patent Application No. PCT/IB2018/052993.

USPTO, Election/Restriction, Mar. 3, 2020, re U.S. Appl. No. 15/736,222.

* cited by examiner

CATHODIC PROTECTION OF METAL SUBSTRATES

CROSS-REFERENCE TO RELATED APPLICATIONS

This application is a divisional of U.S. patent application Ser. No. 16/609,590, having a filing date of Apr. 30, 2018, which is a national phase entry application of PCT/IB2018/052993 having a filing date of Apr. 30, 2018 and which claims the benefit of priority from U.S. Application No. 62/492,570, filed on May 1, 2017, the entire contents of which are hereby incorporated by reference herein.

FIELD

The present invention relates to cathodic protection of metal, mainly steel, substrates.

BACKGROUND

The Impressed Current Cathodic Protection (ICCP) concept is a well known and reliable process for protection of metallic objects, particularly steel, against corrosion. ICCP has been used successfully for pipelines, offshore and onshore constructions, and marine vessels for a long time. ICCP has been used in the automotive industry as well.

Regarding use of ICCP for automobiles, due to the use of small, rigid anodes located at a few different points of the body of the car, there are only a few areas where the electrolyte comes into contact with both anode and cathode to create the electrochemical cell. Thus, such systems tend to protect only these few areas. Therefore, certain areas which are vulnerable to humidity and severe weather conditions such as fenders, rocker panels, insides of the doors, and similar, cannot be readily protected. This means that there are typically only a few small areas of the body of the car that are effectively protected. Also, other parts of the car, especially undercarriage parts, are often not protected at all. U.S. Pat. No. 5,407,549, in the name of Camp, teaches a system in which anodes are connected directly to the cathode along with an electrically conductive medium which includes an electrically conductive sealant that is applied on the topcoat (paint) and the decorative surfaces of the car. One inadequacy of systems like this is that the direct contact of anode and cathode can cause a short circuit, and consequently, violate the concept of ICCP. In addition, such system applies electrically conductive sealant on paint after cracking or coating damage, which can lead to the electrical connection of anode and cathode, which is a short circuit that again violates the concept of ICCP.

In the prior art, systems with a conductive coating is known. In some systems, a metallic bus-bar is used to connect the anode paint to the electrical supply, which can lead to the galvanic corrosion of the bus-bar and the electrical wire in the presence of the electrolyte which consequently will cause the electrical circuit cut off of the cathodic protection of the steel substrate. In this case the bus-bar and wiring become anode and the conductive material of the coating becomes cathode in the generated galvanic cell. In addition, the relatively low electrical conductivity of the conductive paint can present problems with providing the proper amount of voltage to further parts of anode. This is typically overcome by using higher voltages which can result in an over protection phenomenon which causes hydrogen to be released on the surface. Releasing hydrogen can lead to the blistering and damage to the coating and consequently accelerate corrosion on the substrate to be protected.

Regarding use of ICCP for marine vessels, in one common system of cathodic protection, because the anode is submerged in the electrolyte—which is typically sea water—it only protects those parts of the vessel which are also submerged. Therefore, there would be no effective protection for the parts which are intermittently in contact with water or splash or are in contact with moisture in the air or mist. Often in such systems, irrespective of the submerging of the parts, parts which are not facing the anodes or are in the shadow of other parts cannot be adequately protected.

Another inadequacy of common methods for protecting marine vessels is that when the electrolytic characteristics of the water changes, for example, due to changes in salinity (e.g., salt water, brackish water, and freshwater), the voltage and current for effective cathodic protection change as well. If the voltage and current are not calculated or designed correctly, the protection is not effective.

Regarding use of ICCP for steel constructions which are in contact with water, such as piers, pipe pile piers, offshore platforms, bridges, and similar structures, which are often more complicated than marine vessels in terms of protection, common systems of cathodic protection are not as effective as desired. In such structures, there are buried parts which are submerged in water, parts with intermittent contact with water (waves and tides), and parts above the water which are in contact with humid air and mist. Hence, in common cathodic protection systems, in which rigid anodes are placed out of reach of most parts of the cathode surfaces, the anodes cannot be present in the created electrolytes at most parts of the cathode. Consequently, a protective cell cannot be established and the protection is not effective.

Regarding use of ICCP for pipelines, due to the limited surface area of the anodes used for protection and due to the high electrical resistance of typical soils, there is a need for higher voltages and higher current densities which leads to higher costs for equipment and materials. In addition, the electrical resistivity of the soil is often measured along the length of the pipeline in different areas and the amount, size, and type of anodes and the applied voltages and currents for cathodic protection are often calculated using complicated methodologies. In addition, to increase the anode-to-soil electrical conductivity there is a need for backfill and anode beds made of electrically conductive carbonated granules, which increase the cost of the process as well. Moreover, for those parts of pipelines which are not buried and are located above the surface, or such pipelines which are wholly located above the surface, these common methods of cathodic protection are unavailable.

SUMMARY

In solving or mitigating at least one of the problems above, the present invention can protect most or all surfaces of metal (mainly steel) objects as cathodes in various circumstances, including various environmental situations, construction conditions, designs, complicated shapes, and installation conditions, and similar, from the moment the electrolyte is created and the corrosion process begins. The present invention can reduce cost while allowing simplified design, calculation, and application.

According to one aspect of the present invention, a system for corrosion protection includes a metallic object to be protected from corrosion, the metallic object connectable to an electron source as a cathode. The system further includes an electrically isolating coating disposed on at least a portion of the metallic object, a blanket anode applied on at least a portion of the electrically isolating coating, the blanket anode being electrically conductive, and an electrode electrically connected to the blanket anode and connectable to the electron source.

According to another aspect of the present invention, a kit for providing corrosion protection to a metallic object includes a blanket anode configured to be applied onto at least a portion of an electrically isolating coating disposed on the metallic object to be protected from corrosion, the metallic object being connectable to the negative pole of an electron source as a cathode. The blanket anode is electrically conductive. The kit further includes a non-metallic electrode configured to be electrically connected to the blanket anode and to the positive pole of the electron source to which the metallic object is connected.

According to another aspect of the present invention, a method for protecting a metallic object against corrosion includes applying a blanket anode onto at least a portion of an electrically isolating coating disposed on at least a portion of the metallic object to be protected from corrosion, the metallic object connectable to an electron source as a cathode. The blanket anode is electrically conductive. The method further includes electrically connecting a non-metallic electrode to the blanket anode, the electrode being connectable to the electron source.

BRIEF DESCRIPTION OF THE DRAWINGS

The drawings illustrate, by way of example only, embodiments of the present disclosure.

DETAILED DESCRIPTION

Figure 1:
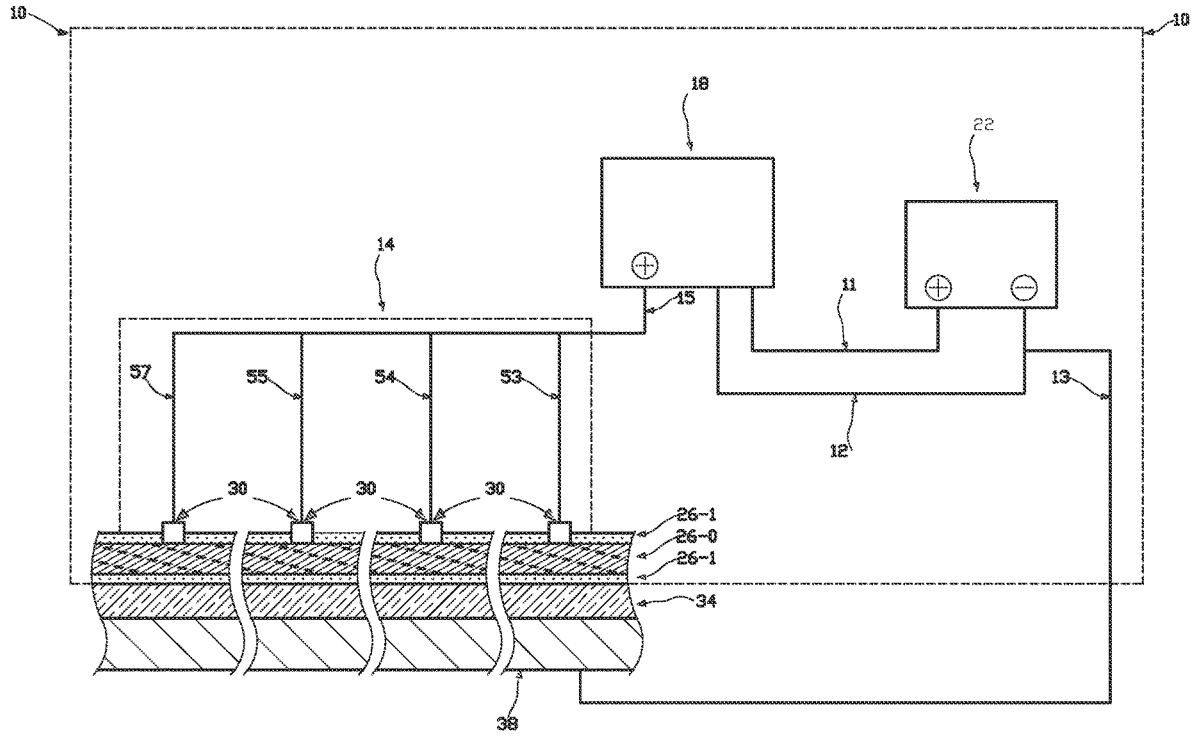
FIG. 1 is a schematic diagram of an electron source, steel object to be protected as cathode, and blanket anode.

FIG. 1 shows a schematic diagram of a system 10 for cathodic protection according to the present invention. The system 10 is an example of the present invention and a variety of different variations and combinations are contemplated. The system 10 provides protection to a substrate that is covered by one or more layers of electrically isolating coating, such as any suitable kind of polymer, paint, primer, or other electrically isolating coating. One or more layers of blanket anode are applied over such substrate and the electrically isolating coating. In this example, the system 10 is applied to the protection of parts of an automobile's body, such as the insides of its doors, against corrosion. However, the system 10 can be used for protection of any other metallic objects (mainly contemplated to be steel objects) such as the entire bodies of vehicles, marine vessels, offshore or onshore constructions, pipelines, and similar.

The system 10 includes a set 14 of one or more electrodes, an electron source 18 or other electrical current provider, a DC power source 22, and a blanket anode 26. The system 10 can be provided as a complete system, such as during manufacture or assembly of the metallic object to be protected. Alternatively, or additionally, the system 10 or a portion thereof can be provided as a kit that is applied after manufacture or assembly of the metallic object to be protected, such as an after-market kit that is applied by the end user or an agent of the manufacturer or assembler.

The blanket anode 26 is disposed over at least a portion of an electrically isolating coating 34 that is disposed on a metallic object 38 to be protected from corrosion. The metallic object 38 is any metallic (mainly steel) object or object subject to corrosion, such as an automobile body or door panel, for example. The electrically isolating coating 34 forms the surface of the substrate for application of the blanket anode 26. The electrically isolating coating 34 can include one or more coats of paint, primer, polymer coating, anodizing, or chemical conversion coatings such as chromate or phosphate conversion coatings especially for non-ferrous alloys, or similar applied to the metallic object 38.

The electrode set 14 includes four electrodes 30, in this example, although any number of electrodes can be used, depending on the size and/or shape of the metallic object 38. Each electrode 30 is in electrical contact with the blanket anode 26 and is electrically connected to the electron source 18 via wires, traces, or other suitable conductor.

The DC power source 22 in automotive applications can be a car's 12-volt battery or similar. In other examples, the power source can be any kind of battery, municipal power supply (e.g., a wall outlet), high-voltage power source, any type of electric generator, a solar power source, or any other kind of power source.

The electron source 18 provides and monitors the flow of electrons (current) between the object 38 to be protected, as cathode, and the blanket anode 26. The electron source 18, in this example, includes a DC voltage reducer that converts an approximate nominal voltage of 12 volts (V) and an approximate current of 60 amperes to about 3 volts and about 300 milliamperes (mA). In other examples, the electron source can be any kind of reducing DC transformer, an AC reducer and rectifier, a device capable of reducing the voltage of a battery (such as a car battery) to a lower voltage, or any other similar device.

The blanket anode 26 includes a single layer or multiple layers of electrically conductive blanket, sheet, or fabric made of carbon fibers for the blanket anode. The blanket anode 26 in this example includes one core layer of Hexcel ACGP124-P-50" ZB carbon fiber fabric 26-0. For bonding the carbon fiber fabric over an electrically isolating coating 34 in this example a layer of bonding resin consisting of 5% by weight 10 μm of graphite powder in the air dryable polyurethane resin, binding layer 26-1 is applied over the electrically isolating coating 34, then the carbon fiber fabric, core layer 26-0 is laid down over the binding layer 26-1. After about 10 minutes, the bond becomes strong enough for another layer of the resin mixture of binding layer 26-1 to be applied over the carbon fiber fabric. This blanket coating 26 has a surface electrical resistance of about 0.45 Ohm/Square which significantly reduces the electrical resistivity of the conductive coating when compared with other types of conductive powders and mixtures and improves adhesion to the surface due to its much lower amount of powder additives in the binding layer and the resin. These characteristics of the blanket anode makes it suitable for application of this technology on the complex shape designs with narrow sections.

In various implementations of the present invention the blanket anode 26 can include one or more of core layers 26-0 of different types of carbon fiber fabrics or any other types of carbon fiber shapes such as sheets, fabrics, etc., being bonded to the electrically isolating coating on the metal substrate by any kind of adhesive, glue, resin with or without electrically conductive filler as binding layer 26-1. The binding layer 26-1 may be a polymer, resin or glue, or may contain an amount of conductive materials, mixtures, and powders, such as graphite, activated carbon, Graphene, carbon Nanotubes, or any other mixtures of the conductive materials. The blanket anode can be used as outer layer of the coating or middle layer for sandwich type of application, depending on the industry or corrosive environment. In a sandwich type application, the top coat over the blanket anode can include of one or more layers of coatings such as primer paints, top coat paints or top clear coats, etc.

It is to be appreciated by a person of skill in the art that the released hydrogen due to cathodic protection mechanism can decrease the performance of the coatings or metal structure. In this case, released the hydrogen ions can form hydrogen molecules underneath the coating of the metallic substrate causing blistering and leading to the damage on the coating. In addition, hydrogen ions may also defuse into the metal structure and cause hydrogen embrittlement especially in harder metals and welded areas. The generation of hydrogen can be addressed by adding hydrogen absorbent materials, in the binding layer 26-1, to prevent blistering on the coating. Furthermore, hydrogen absorbent materials may also be added into the electrically isolating coating 34 below the blanket anode or any other layer in the total coating, combined or separated.

An example of hydrogen absorbent material can be a mixture of 0.5% wt silver oxide 2-10 μm powder with 4.5% wt manganese dioxide 2-10 μm powder in the binding resin. It is to be appreciated that the exact hydrogen absorbent material is not particularly limited and that any kind or amount of hydrogen absorbent mixtures and materials can be used in any kind of resin or glue, or separate from the resin or glue.

In this example blanket anode 26 consists of one layer of electrically conductive binding layer containing hydrogen absorbent mixture. Thus the binding layer 26-1 consisting of 5% wt 10 μm graphite powder, 4.5% wt 2-10 μm manganese dioxide powder, 0.5% wt 2-10 μm silver oxide powder in the air dryable polyurethane resin, applied over the electrically isolating coating 34, one layer of Hexcel ACGP124-P-50" ZB carbon fiber fabric, core layer 26-0 in the middle, and another layer of electrically conductive binding layer 26-1 containing a hydrogen absorbent mixture over it. One of the advantages of present invention is that the solid content of the conductive resin is less than 10% which is an acceptable amount of pigment additives for the common paints. Thus, the adhesion characteristics and the porosity of the coating will remain at standard requirements for paints. In addition, the electrical conductivity of blanket anode of present invention is much higher than the anode of the prior art making it superior and able to be applied in wider range of industries.

It is contemplated that when selecting a type or combination of materials for a blanket anode 26 according to the present invention, the surface electrical resistivity of the layers of the blanket anode 26 should be measured and used for calculation of voltage and current and for configuration of the specific electron source 18 used for cathodic protection, as well as for calculating and designing the numbers of electrodes 30. Another consideration is that, before applying the blanket anode 26 onto the electrically isolating coating 34, such as automobile paint or primer, the surface should be completely degreased, cleaned and free of any contamination.

In some conditions, such as long range marine vessels that may experience sea water composition changes from brackish water to water of high salinity that can cause different corrosion reactions. According to the present invention, because of the excellent corrosion resistivity along with high electrical conductivity of the carbon fiber/carbon fiber fabric, the blanket anode 26 can be used as one or more core layers 26-0 in the middle of the two layers of binding layer 26-1 or without them, for long range marine vessels and land-based military vehicles in all different harsh corrosive environments, regardless of change in corrosivity of the sea water or environment.

When applying the blanket anode as a sandwich layer underneath the coatings of the marine vessels and military vehicles, one or multiple layers of hydrogen absorbent material can be used due to the harsh operating conditions. For example, a layer of a coating containing hydrogen absorbent mixture can be applied below and a layer of coating containing hydrogen absorbent mixture can be applied over the blanket anode having the sufficient thickness, at least 25 μm in dried film. The hydrogen absorbent mixture may also be added into primer or electrically isolating coating 34 below the binding layer 26-1.

Figure 3:
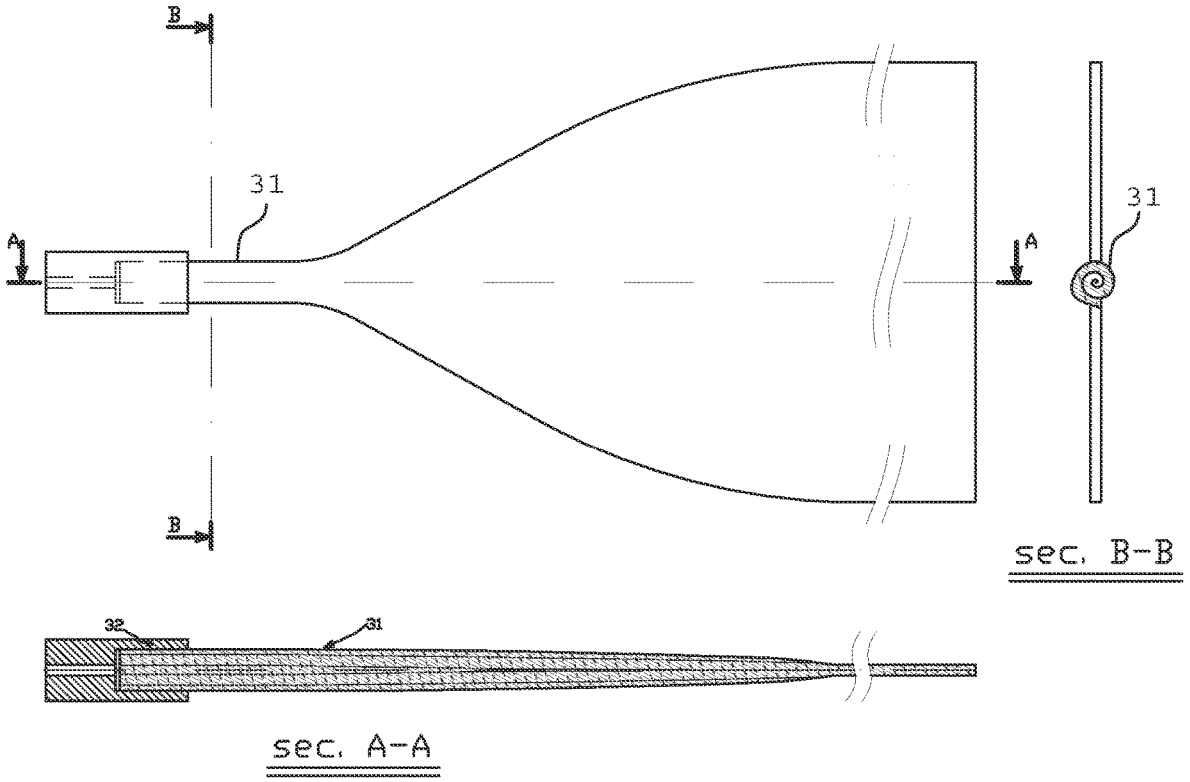
FIG. 3 is diagram of a flexible non-metallic electrode.

An example of a flexible non-metallic electrode 30 according to the present invention is shown in FIG. 3. The flexible non-metallic electrode 30 includes a strip of carbon fiber fabric 31 and a parallel connector 32 which is attached to one end of the carbon fiber fabric strip 31. The connector 32 in this example is of Del City parallel connector #214205. The connector 32 can be of any type or shape and material to make a suitable electrical connection of one end of the carbon fiber fabric 31 to the suitable wiring of the circuit. The carbon fiber fabric strip 31 in this example is Hexcel ACGP124-P-50" ZB carbon fiber fabric with the width of 25 mm and length of 150 mm. The carbon fiber fabric strip 31 can be made of any type of carbon fiber fabric of any shape and size. The strip 31 can also be of any kind of flexible non-metallic electrically conductive material or mixture.

The flexible non-metallic electrode 30 has some notable advantages over the metallic electrodes. Metallic electrodes may be subject to galvanic corrosion in direct contact with corrosive environment and electrolyte even if covered with different kinds of electrically insulation coatings. Therefore, the galvanic corrosion will eventually cause the circuit cut off on the ICCP process and cause the corrosion on substrate to be protected. Because of the non-metallic nature of the flexible non-metallic electrode, there will be no galvanic corrosion on the attached electrode into the blanket anode. Therefore, this method can be easily applicable on any complicated substrate design and harsh corrosive environments.

When using the carbon fiber fabric strip 31 and such alike, the capillary characteristic of the fabric can draw the liquid electrolyte from the anode to the connection point to the wiring causing corrosion on the wiring and connectors leading to protective circuit to be cut off. To reduce the capillary action in this example, the surface of both sides of a 30 mm long part of the strip 31, closer to the connector 32 should be coated by a resin or some ordinary non-metallic paint, polyurethane for example, and folded over tightly while the resin is still wet and let it dry in folded shape. And finally, the part of the flexible electrode containing the connector and attached electrical wire should be far from the protection area and thoroughly covered with an electrically insulating coating such as epoxy resin or glue or any other kind of electrically insulating resin, paint or glue coating. The coating should cover at least 5 cm of the strip 30 along with the connector 32 to prevent further capillary action in case the strip 30 gets contacted with the electrolyte. It is to be appreciated that this example of addressing the capillary action on the electrode 30 is not limited and that other methods are contemplated. For example, the folded side of the electrode 30 may be connected to one end of a graphite rod, and may be connected the other end of the graphite rod to the wiring connector.

Due to the nature of the flexible non-metallic electrode, in some cases a part of blanket anode can be considered as the strip 31 and attached to the connector 32 applying all considerations of the electrode 30.

Figure 4A:
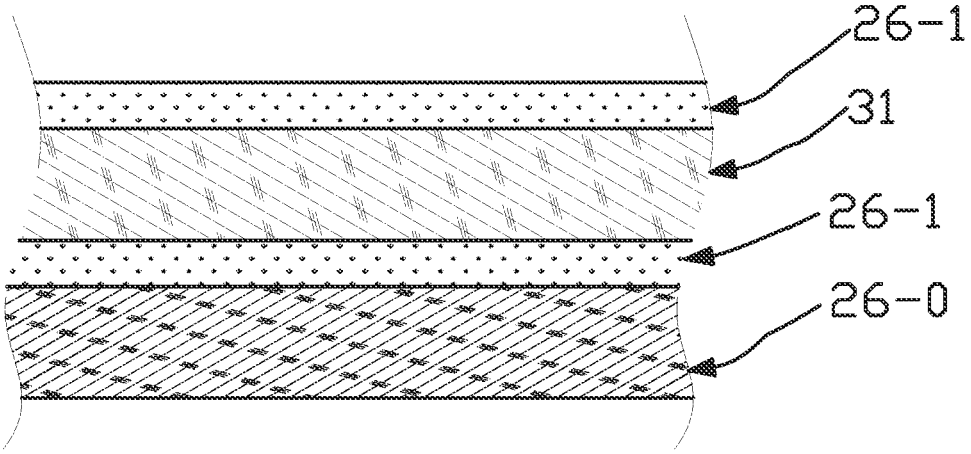
FIG. 4A is a view of the electrode embedded in the blanket anode.
Figure 4B:
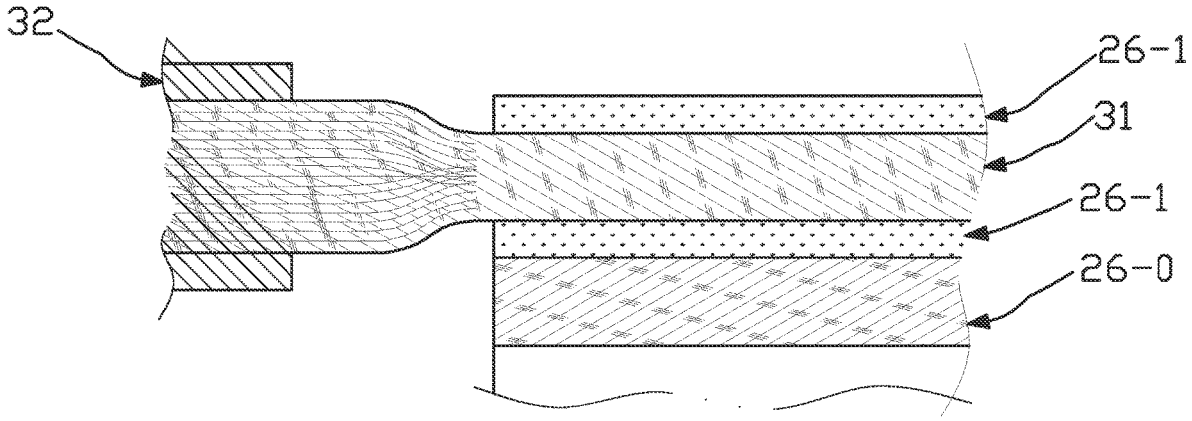
FIG. 4B is a front view of the electrode embedded in the blanket anode.
Figure 4C:
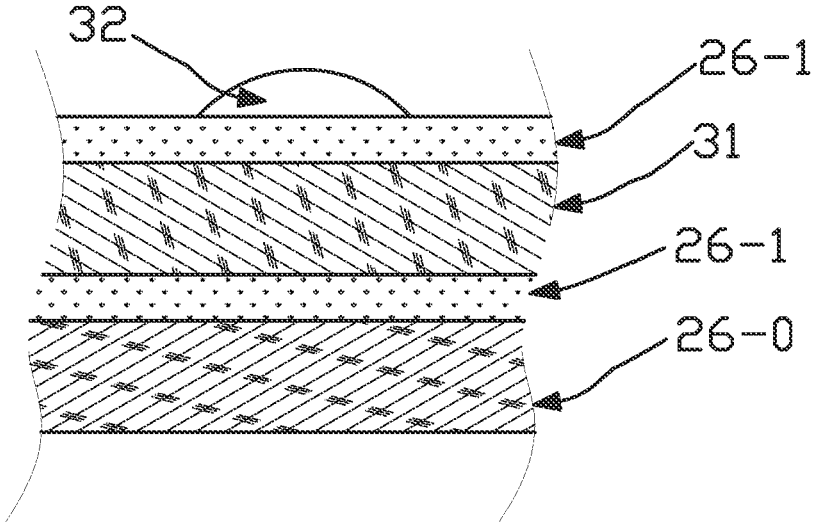
FIG. 4C is a side view of the electrode embedded in the blanket anode.

An electrically conductive resin should be used for installing the electrode 30 on the blanket anode 26. An example of electrically conductive resin for this purpose according to the present invention is the electrically conductive binding layer 26-1 without hydrogen absorbent. To bond the electrode 30 on the core layer 26-0 of the blanket anode 26, as shown in FIGS. 4A-4C, one coat of binding layer 26-1 is applied over the core layer 26-0 and the strip 31 of the electrode 30 is located over it. After about 10 minutes, another layer of electrically conductive binding layer 26-1 is applied over the assembled area. As shown, the parallel connector 32 and a part of the strip 31 protrude from the exposed location outside the blanket anode 26, so as to facilitate a good electrical connection.

With reference back to FIG. 1, input wires 11 and 12 electrically connect the positive and negative poles of the DC power source 22 to the electron source 18. In this example, because the metallic object 38, which is the cathode being protected, is a part of or an entire automobile body that is intended to be connected to the negative pole of its battery (i.e., DC power source 22) by wire 13, there is no need to provide a separate negative connection through electron source 18 to the object 38.

When applying the blanket anode 26, first of all the surface of the electrically isolating coating 34, should be thoroughly degreased and cleaned. The binding layer 26-1 should be well mixed to achieve a homogeneous mixture of resin or other coating material and filler. The first layer of binding layer 26-1 is applied by brush or spray gun onto the electrically isolating coating 34 with a thickness of, in this example, about 25 micrometers. According to the curing time of the resin material used, when it is partly dried and is still sticky/tacky (in this example, after about 2 minutes) the core layer 26-0 which has been cleaned and degreased is gently pushed on the binding layer 26-1 to become fixed and secured at its appropriate location. To install the electrodes 30 on the core layer 26-0, a layer of the conductive binding layer 26-1 is applied by spray gun or brush on the proper location on the core layer 26-0, when it is partly dried and is still sticky/tacky (in this example, after about 2 minutes) the electrodes 30 which have been cleaned and degreased, are gently pushed into the first layer to become fixed and secured at the appropriate locations. Then, the second layer of the binding layer 26-1 is applied over the first layer and over the electrodes 30 to embed the electrodes 30 completely in the blanket anode, as shown in FIGS. 4A-4C, with the exception of the ends of the terminals 32. The blanket anode 26 is then completely cured (e.g., for 30 minutes, in this example, or other suitable time). The second layer of blanket anode 26 may be the outer layer. A separate topcoat may be applied over the blanket anode 26. Electrode 30 can be secured on/in the blanket anode 26 by any other method to electrically connect the blanket anode 26 to the electron source 18. After the blanket anode 26 is cured, wires 53, 54, 55 and 57 are connected to the exposed terminals 32 of the electrodes 30. Then the terminals 32 and the extended areas of their both sides of the length of at least 10 mm are thoroughly covered with an electrically isolating resin or glue or such alike to provide a water proof electrically isolation of the connections and let them to be dried, in this example about 30 minutes for the polyurethane resin. Then connect the other end of the wires to the positive output of the electron source 18, as shown in FIG. 1. This process may be repeated for any number of surfaces/sides of the object 38 to be protected.

Figure 2:
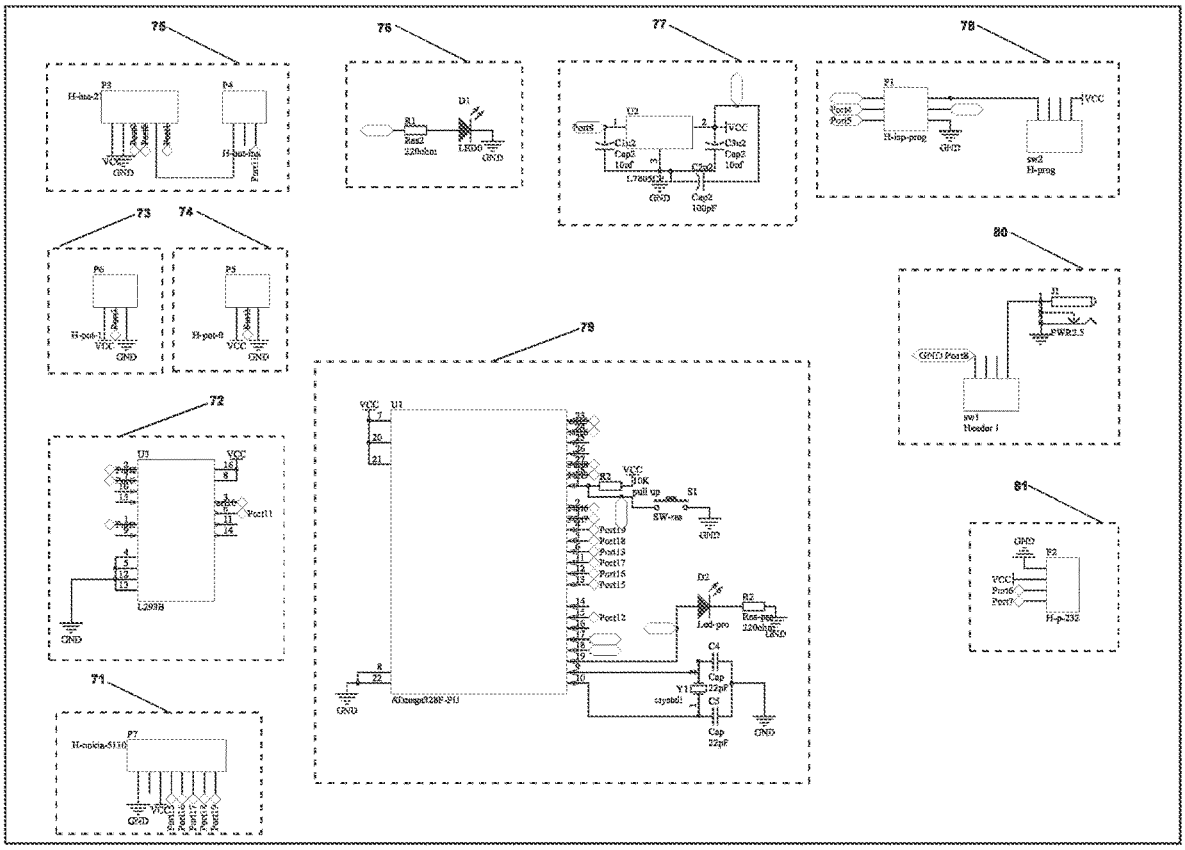
FIG. 2 is a circuit diagram of the electron source.

As shown in FIG. 2, the electron source 18 can include a LCD Nokia 71, a current buffer 72, a flow control 73, a voltage control 74, a voltage sensor and current control 75, a voltage indicator 76, a power supply 77, a programming port 78, a micro controller 79, a power plug and switches 80, and a serial communication port 81. These components can be interconnected as shown. The ground line 75 connects to the metallic object to be protected (cathode), the ground terminals (GND) of the microcontroller 79, and the negative pole of the DC power source 22. The power supply 77 connects to the positive pole of the DC power source 22 and provides power to the relevant ports of the microcontroller 79. The flow and voltage controls 73 and 74 connect the microcontroller 79 to the electrodes 30 and blanket anode 26. The microcontroller 79 is configured to provide and monitor electron flow (electric current) between the metallic object 38 being protected and the blanket anode 26, and further to output status information based on electron flow via the LCD Nokia 71. In addition, the microcontroller 79 can be programmable for different levels of electron flow and status information, via the programming port 78. For example, the microcontroller 79 can store a lookup table that associates levels of measured electron flow with output signals provided to the indicators.

The electron source 18, in this example, is programmable, can control the both the output voltage and current, and can be programmed to use any number of LEDs, LCDs or other indicators to indicate different alarms and warnings. LEDs can be pulsed and/or separately illuminated to convey any amount and type of information regarding operation of the system 10. Other types of indicators 71 are contemplated, such as screens for detailed alphanumeric status information, speakers for audible status information, and similar.

The electron source 18, in this example can be supplied with solar batteries and wireless communication systems for applications for pipelines.

Figure 5:
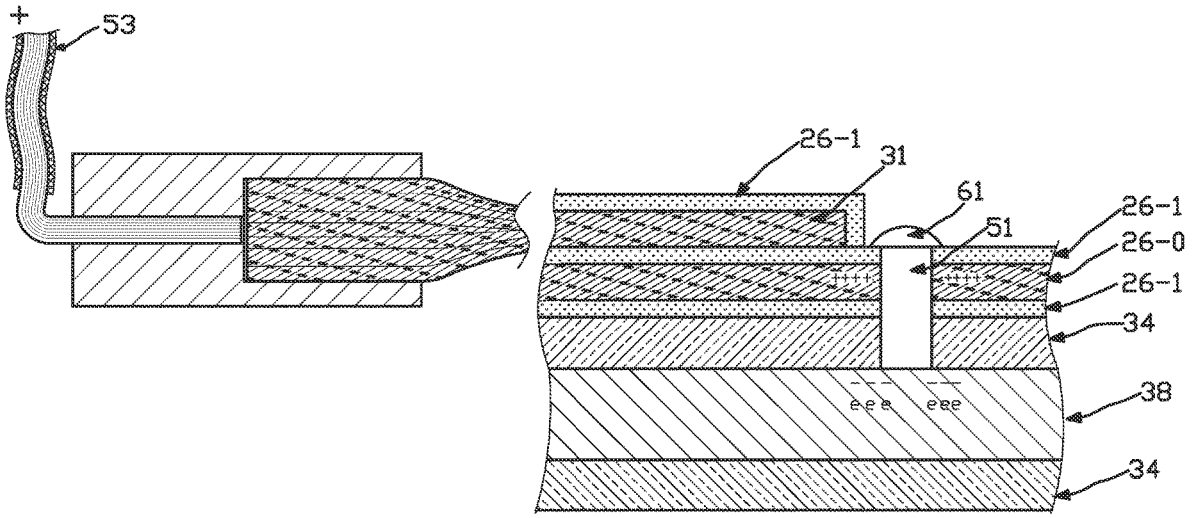
FIG. 5 is a cross-sectional view showing the mechanism of cathodic protection on one side of a substrate.

FIG. 5 shows the mechanism through which the present invention is contemplated to operate. A metallic object 38, i.e., steel substrate, is protected on one side. In this example, the blanket anode 26 is applied on a surface whose appearance is not of major concern, such as an inside surface of an automobile body component. After the electron source 18 is activated, a part of the combination of the blanket anode 26 and isolating coating 34 gets damaged (e.g., cracked) or becomes missing and the resulting aperture 51 exposes the bare surface of the metallic object 38 being protected. At the moment the electrolyte 61, which can be any type of oxidizing or corrosive medium, such as water condensate or mist (with or without road salt, sea salt, etc.), penetrates into the aperture 51 and touches the surface of the metallic object 38, the cathodic protection of the present invention is activated and becomes operational to reduce corrosion.

The cathode 38 and blanket anode 26 are separated by one or more layers of electrically isolating material 34 and are connected to the electron source 18 that provides a current of electrons. Hence, in a corrosive environment when an electrolyte 61 is created and comes into contact with the surfaces of the blanket anode 26 and cathode 38, an electrochemical cell will be created in which, at this moment, the potential difference between the blanket anode 26 and cathode 38 will concentrate the oxidation process on the anode of the cell and suppress the corrosion process at the cathode. At this moment, cathodic protection is established and reduces corrosion of the cathode.

Figure 6:
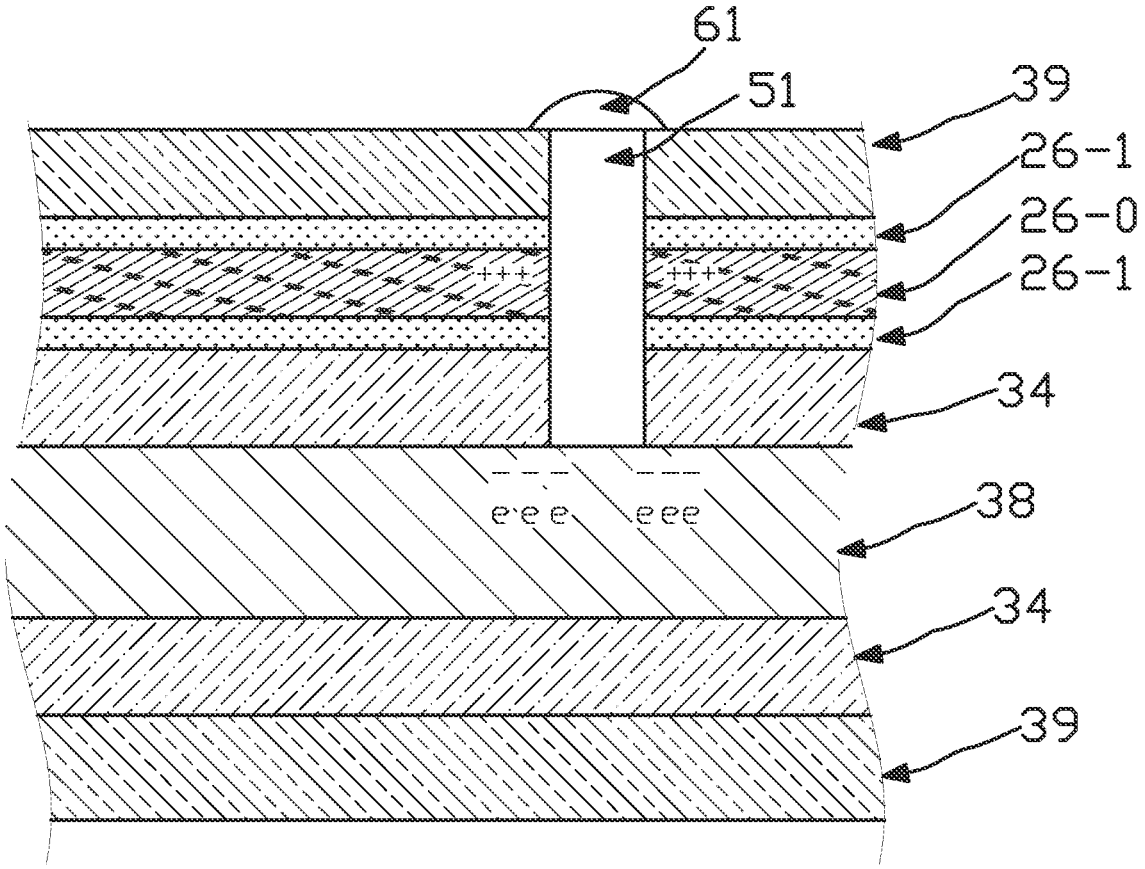
FIG. 6 is a cross-sectional view showing the mechanism of cathodic protection on one side of a substrate with a topcoat.

FIG. 6 also shows the mechanism through which the present invention is contemplated to operate. A metallic object 38, i.e., steel substrate, is protected on one side. In this example, the blanket anode 26 is applied before a topcoat 39 is applied. This arrangement can be used for surfaces for which appearance is important, such as the outside of an automobile body panel. In this case, the binding layer 26-1 should contain the proper amount of the hydrogen absorbent mixtures. An example of hydrogen absorbent material can be a mixture of 0.5% wt silver oxide 2-10 μm powder with 4.5% wt manganese dioxide 2-10 μm powder in the binding resin. It is to be appreciated that the exact hydrogen absorbent material is not particularly limited and that any kind of hydrogen absorbent mixtures and materials can be used in any kind of resin or glue, or separate from the resin or glue.

Figure 7:
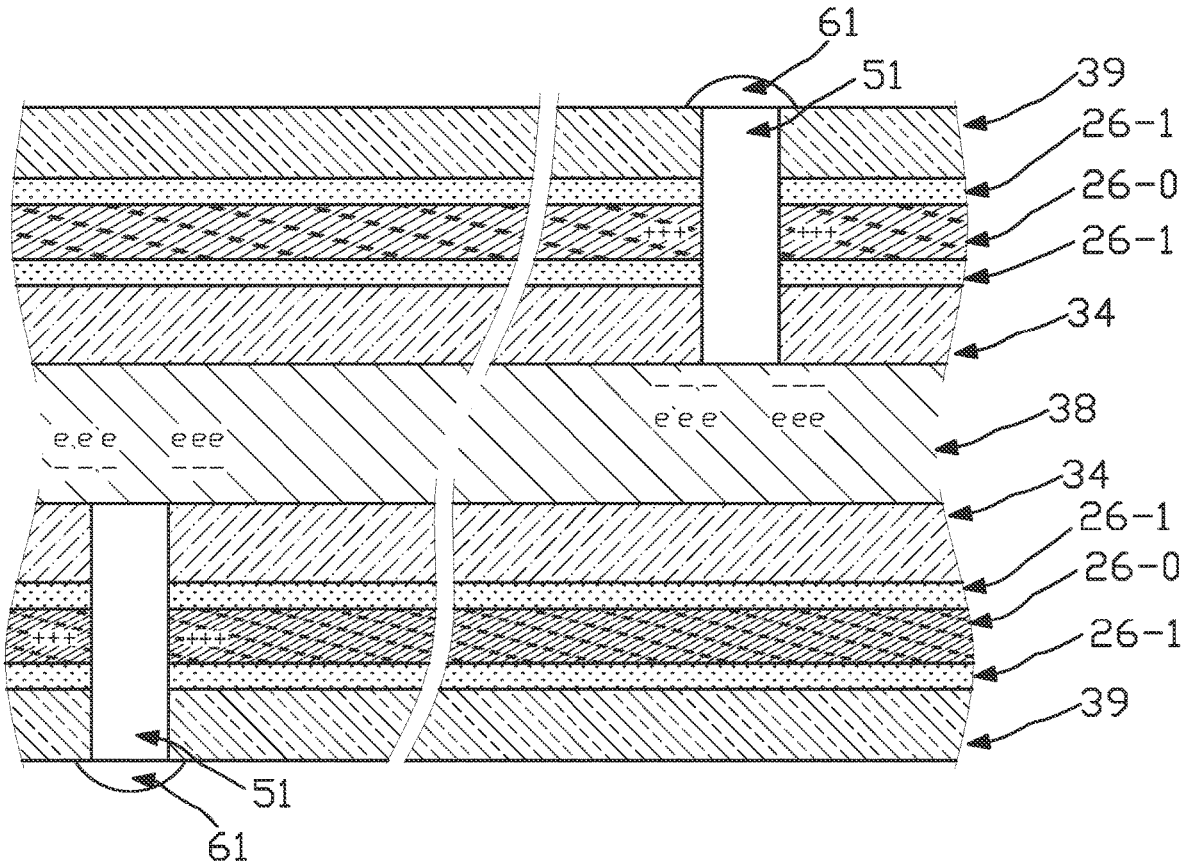
FIG. 7 is a cross-sectional view showing the mechanism of cathodic protection on two sides of a substrate with topcoat.

FIG. 7 further shows the mechanism through which the present invention is contemplated to operate. A metallic object 38, i.e., steel substrate, is protected on two opposite sides. In this example, the blanket anode 26 is applied to each side before a topcoat 39 is applied. This arrangement can be used for objects for which appearance of both sides is important. In this case, the binding layer 26-1 should contain the proper amount of the hydrogen absorbent mixtures. An example of hydrogen absorbent material can be a mixture of 0.5% wt silver oxide 2-10 μm powder with 4.5% wt manganese dioxide 2-10 μm powder in the binding resin. It is to be appreciated that the exact hydrogen absorbent material is not particularly limited and that any kind of hydrogen absorbent mixtures and materials can be used in any kind of resin or glue, or separate from the resin or glue.

Depending on the design factors, the amount of carbon fiber fabric (blanket anode) and covering anode (consisting of a combination of any electrically conductive solid including carbon nanotubes, Graphene, metal coated graphite, etc.) may be varied. These amounts may used individually or combined on the one or more layers over the insulating layer.

Regarding vehicular applications for the present invention, a major problem, which makes the battle against corrosion more difficult and complicated, is that corrosion generally starts at internal and hidden areas of vehicle body parts. Corrosion often cannot be seen and recognized in its early stages. This is known as inside-out corrosion in the automotive industry. In most cases in such situations, when it becomes visible it is too late and the damage is already considerable. Some impressed current cathodic protection (ICCP) techniques are not reliable in this situation because the anode is not in contact with the electrolyte in such areas. However, in the present invention, in which the anode is applied on the cathode's surface over its electrically insulating coating or primer, as a topcoat, paint, or a layer in between electrically insulating basecoat/primer and topcoat, hidden areas and complexly shaped parts and areas are within reach of the anode. Hence, from the moment the electrolyte is created, the corrosion protection circuit is established and the relevant portions of the vehicle's body will be protected. It should be understood that in the present invention the electrical circuit is not activated unless corrosion has begun, meaning that the vehicle's battery, which serves the electron source, will not significantly discharge to drive the electrical circuit until the corrosion reaction begins. However, even when corrosion occurs, the amount of battery consumption is very low, about 1.2 to 3 volts and mostly below 10 milliamperes, even in severe cases. This level of power consumption is almost negligible for the vehicle's battery.

Because in the present invention the anode conforms to its supporting surface (e.g., the cathode) and can be applied over irregular and curved surfaces, the present invention can be used for corrosion protection of vehicle undercarriage areas, such as chassis and suspension systems.

The present invention reduces or removes the need for double-sided galvanized steel sheets and the inner surfaces of body panels can be bare steel without zinc coating, although the invention can be used for galvanized steel and to protect sacrificial zinc coating as well. Therefore, after applying the primer coating on an entire body surface through the pre-painting process, the inner surface can be covered by the blanket anode while the outer surface can be either covered by topcoat and final paint without the blanket anode or by a blanket anode in between a basecoat and topcoat, along with hydrogen absorbent mixtures and materials. Hydrogen absorbent materials and mixtures may also be added into the primer coating along with the binding layer or instead of it. Hence, according to the present invention, corrosion protection can be applied on the whole body of a vehicle, resulting in better corrosion protection, especially in severe corrosion conditions, along with the lower production costs. Another benefit of the elimination or reduction of zinc coating on inner surfaces is the elimination or reduction problems in resistance welding galvanized steels in vehicle body assembly processes. Problems with resistance welding, such as spot welding or seam welding, zinc-coated steel sheet include the creation of brittle zinc-steel alloy which reduces the mechanical properties and strength of welded areas and may negatively affect the aesthetic appearance of such welded areas. Another benefit of the application of the blanket anode is a dramatically increase in stiffness, strength, shock absorbing, and impact resistance of the vehicle's body due to characteristics of carbon fiber fabric and the steel-carbon fiber composite-like made of it. This advantage would be a great help for vehicle body designers to increase the safety of vehicles in collisions while reducing the production costs, reducing the weight of the car's body by eliminating one side zinc coating and reducing the sheet metal thickness, and reduction in fuel consumption as well.

Regarding applications for marine vessels, because the blanket anode of the present invention can be applied to any surface, along with the hydrogen absorbent materials and mixtures in the anode layer or any other coating layer, or without hydrogen absorbent materials and mixtures, intermittently exposed components can be well protected along with continuously submerged parts. That is, parts of the vessel subject to intermittent contact with water, such as due to splashing, waves, humidity, mist, and similar, can be protected in the same manner as parts that are well below the waterline.

In addition, because the blanket anode is applied on all surfaces—over the electrically isolating layer—of the cathode, submerged parts can be well protected, as compared to some cathodic protection techniques in which submerged parts which do not directly face the anodes may not be completely protected.

Moreover, because of the small distance between anode and cathode in the present invention, the electrical resistivity of water can be neglected, specifically when designing cathodic protection for the long-range vessels. The same calculations can cover many or all circumstances such as sea water, brackish water, or fresh water. Thus, because there is no need to change the voltage or current density, when electrical resistivity of the water changes, the complexity of the design will be greatly reduced resulting in lower costs.

Another benefit of the application of the blanket anode for marine vessels is a dramatically increase in stiffness, strength, shock absorbent, and impact resistance of the vessel's body due to characteristics of carbon fiber fabric and the steel-carbon fiber composite-like made of it.

Moreover, because of the different shapes of carbon in the coating and applied electricity, the coating has excellent antifouling characteristics which leads to drastic reduction in fuel consumption and drag of hazardous materials into the sea water.

Regarding applications for pipelines, it is contemplated that a blanket anode can be applied over isolating coating layers on pipelines, either as topcoat or in between two coating layers along with hydrogen absorbent agents. There is no need to measure soil electrical resistivity in different areas of the pipeline path or to use backfill for the anodes. Complicated calculations and design considerations are reduced and the voltage and current used for the protection are reduced, resulting in better protection and lower costs. Furthermore, for those parts of the pipelines which are not buried or for the pipelines which are wholly over the ground and exposed, for which some impressed current cathodic protection systems cannot be used, the blanket anode can be applied all over the pipeline's primer coating either as topcoat or in between two coating layers along with hydrogen absorbent agents and consequently corrosion protection is established on any part of the exposed pipeline in which the coating is damaged, right at the moment the electrolyte is created.

It is contemplated that because of the high electrical conductivity, the carbon fiber fabric core 26-0 of the blanket anode can be partially applied on the pipeline, such as a 5 centimeter strip to be longitudinally applied on the pipe, and the rest of the pipe's surface can be coated by electrically conductive coating of 26-1 binding layer.

It is contemplated that for buried pipelines, or for those parts of pipelines which are buried, because of the electrical conductivity of the soil, the blanket anode can be partially applied on the pipeline and there is no need for it to be applied over the entire surface of the pipeline. For example, the blanket anode can be longitudinally applied on the pipe in a strip with a width of 5 centimeters or in any other shape or pattern. In this case there would a higher voltage is used due to the soil's relatively lower electrical conductivity.

Application of the hydrogen absorbent materials and mixtures either into the electrically isolating coating or blanket anode protects the system from probable damages from the hydrogen release due to over protection voltages. In some applications such as gas and oil pipelines which safety is the main concern, the excessive amount of hydrogen can saturate all of the hydrogen absorbent materials and causes blistering on the substrate's coating, some more hydrogen absorbent material can be injected into the blistered area. The whole protection system can then be used continuously until the next scheduled overhaul cycle where a proper repair can be performed. Accordingly, this system dramatically reduces the cost and efforts and increases the effectiveness of the monitoring of the gas and oil pipelines. This method can be applied to the other industries as well. The hydrogen absorbent mixtures also can be applied solely over the welded joint surfaces to reduce the hydrogen embrittlement on the welded areas and their Heat Affected Zone (HAZ) which may provide a decrease in the cost.

One significant advantage of present invention is its capability to overcome stray currents problems for buried pipelines or structures and submerged structures. Using a blanket anode all over a metallic substrate, such as steel pipe, can act as a Faraday cage when stray currents hit the structure to be protected. Stray currents have been one of the major problems for cathodic protection of buried or submerged structures. By reducing stray currents from entering the metallic substrates, galvanic corrosion of the substrates due to stray currents is reduced. Therefore, the high cost, effort, survey, and time to manage and control of stray currents will be reduced in cathodic protection by the present invention.

For steel constructions which are partially buried or in contact with water such as piers, pipe pile piers, offshore platforms, bridges, these structures can be effectively protected by the present invention because of the nature of the blanket anode. As described elsewhere herein, the blanket anode is applied all over the electrically isolating primer or coating of the structure, which becomes the cathode, either as topcoat or in between the two coating layers along with hydrogen absorbent agents in the blanket anode or into the electrically isolating coating. Corrosion protection is established at any part of the structure in which its coating is damaged right at the moment the electrolyte is created.

Above are some examples for applications of the present invention. However, these examples are not limiting and the present invention can be used for a part or a whole surface of any metallic (mainly steel) object which is to be protected against corrosion, more effectively, easier, and cheaper than some cathodic protection methods.

Further, it is advantageous that, because of the relatively small distance between cathode and blanket anode, which is as small as the thickness of the electrically insulating coating on the cathode, the amount of voltage and current for the process is small compared to some other techniques. This can result in higher effectiveness and lower costs. Further, it is advantageous that power is not consumed until the corrosion process begins. Other advantages of the present invention will be apparent from the above description.

While the foregoing provides certain non-limiting example embodiments, it should be understood that combinations, subsets, and variations of the foregoing are contemplated. The monopoly sought is defined by the claims.

What is claimed is:

1. A method for protecting a substrate against corrosion, the method comprising:

applying a blanket anode onto at least a portion of an electrically isolating coating disposed on a portion of the substrate to be protected from corrosion, wherein the substrate is to connect to an electron source as a cathode;

connecting a non-metallic electrically conductive connector at a first end to the blanket anode;

forming a capillary action prevention portion at a second end of the non-metallic electrically conductive connector by:

applying a coating to a length of the non-metallic electrically conductive connector;

folding the length of the non-metallic electrically conductive connector into a tight coil while the coating is wet to trap at least a portion of the coating in the folded length; and drying the coating while the length is folded, such that the dried portion of the coating trapped in the folded length prevents capillary action through the folded length; and connecting the second end of the non-metallic electrically conductive connector to the electron source at the capillary action prevention portion via a wire.

2. The method of claim 1, further comprising applying a hydrogen absorbent material and/or mixture.

3. The method of claim 1, further comprising applying a topcoat over at least a portion of the blanket anode.

4. The method of claim 1, further comprising applying the blanket anode on opposite sides of the substrate.

5. The method of claim 1, further comprising a microcontroller monitoring electron flow between the substrate and the blanket anode.

6. The method of claim 5, further comprising the microcontroller outputting status information via an indicator based on the electron flow.

7. The method of claim 6, further comprising first applying a first binding layer of the blanket anode over the electrically Isolating coating, applying a core layer of a carbon fiber fabric over the first binding layer, applying a second binding layer over the core layer, applying a carbon fiber fabric electrode over the second binding layer, and applying a third binding layer over the carbon fiber fabric electrode.

8. The method of claim 1, further comprising providing antifouling properties for marine applications.

9. The method of claim 1, further comprising monitoring electron flow between the substrate and the blanket anode at a microcontroller of the electron source.

10. The method of claim 9, further comprising outputting, at an indicator, status information for the substrate to be protected based on the electron flow.

11. The method of claim 1, further comprising providing a graphite rod between the folded length of the non-metallic electrically conductive connector and the wire.

* * * * *